US006475100B1

(12) United States Patent
Helmstetter et al.

(10) Patent No.: US 6,475,100 B1
(45) **Date of Patent: *Nov. 5, 2002**

(54) GOLF CLUB HEAD WITH ADJUSTABLE FACE ANGLE

(75) Inventors: Richard C. Helmstetter, Rancho Santa Fe, CA (US); Andrew J. Goodjohn, Vista, CA (US); Donald A. Bistline, Vista, CA (US); James C. Wenck, Carlsbad, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 09/686,034

(22) Filed: Oct. 11, 2000

(51) Int. Cl.[7] ..... A63B 53/02
(52) U.S. Cl. ..... 473/309; 473/314; 473/345
(58) Field of Search ..... 473/244–248, 473/307, 309, 310, 311, 314, 345, 346

(56) References Cited

U.S. PATENT DOCUMENTS 4,948,132 A * 8/1990 Wharton
5,197,733 A 3/1993 Schroder
5,452,890 A * 9/1995 Bingman
5,470,068 A * 11/1995 Schmidt
5,575,723 A 11/1996 Take et al.
5,626,528 A 5/1997 Toulon
5,839,973 A 11/1998 Jackson
5,851,155 A 12/1998 Wood et al.
5,906,549 A 5/1999 Kubica
6,146,286 A * 11/2000 Masuda

* cited by examiner

*Primary Examiner*—Stephen Blau
(74) *Attorney, Agent, or Firm*—Michael A. Catania

(57) ABSTRACT

The golf club (20) of the present invention allows for the face angle of the golf club to be set after manufacturing of the golf club head (22). The golf club (20) of the present invention is able to accomplish this by providing a golf club head (22) with an internal hosel (38) (such as a GREAT BIG BERTHA® HAWK EYE® driver), a shaft (40) and an insert (51) that is disposed within the internal hosel (38). The insert (51) allows for the face angle of the golf club (20) to be oriented after manufacturing of the golf club head (22). The golf club (20) may also include a hosel liner (50) that is disposed within the insert (51).

7 Claims, 5 Drawing Sheets

GOLF CLUB HEAD WITH ADJUSTABLE FACE ANGLE

CROSS REFERENCES TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention relates to a wood-type golf club. More specifically, the present invention relates to a wood-type golf club head with the capability to adjust the face angle.

2. Description of the Related Art

In order to improve their game, golfers seek customization of their equipment to their particular swing. Golf equipment manufacturers have responded by increasing the different types of clubs available to the average golfer. For drivers, this has included increasing the different number of lofts readily available to the average golfer. Further, the average golfer can choose the type of shaft, whether metal or graphite, appropriate to the golfer's swing. Additionally, the length of the shaft may be adjusted, and the type of grip can be customized for the golfer.

However, golfers demand perfection, and every possible adjustment must be made to fit a particular golfer's swing. Thus, drivers that allow for adjustments in the lie angle and face angle have been made available to golfers. One such driver is Jackson, U.S. Pat. No. 5,839,973 for a Golf Club Head With Enlarged Hosel, originally filed in 1996. The insert of Jackson is removable thereby allowing for another insert with a different shaft orientation to be inserted into the hosel. The insert of Jackson has a diameter that is much larger than that of the tip end of the shaft.

Another example is Schroder, U.S. Pat. No. 5,197,733, filed in 1990 for a Golf Club. The Schroder patent discloses a club head with an elongated lower shaft portion that can be rotated to adjust the face angle of the golf club. The lower shaft portion is adjustable by rotating the shaft to accommodate the golfer, however, the tip of the shaft will be disposed behind or in proximity to the center of percussion of the golf club. Additionally, Schroder requires a particular shaft, with a lower angled portion, for the golf club head.

A further example is Toulon, U.S. Pat. No. 5,626,528, filed in 1996, for a Golf Club Head And Hosel Construction. The Toulon patent discloses a hosel with a slot groove that provides for adjustment of the face angle by five degrees and the lie angle by seven degrees by application of a transverse bending force on the hosel.

A further example of such an invention is Wood, et al., U.S. Pat. No. 5,851,155, which was originally filed in 1997. The Wood patent discloses a hosel that allows for customization of the face angle for a particular golfer by reorienting the club head relative to a neck member of the hosel.

Yet a further example is Kubica, U.S. Pat. No. 5,906,549 which was filed in 1997 for a golf club and a multitude of hosels with each hosel having a passage with a different angle relative to the club head. Each hosel has a flat portion for securing the hosel within a bore in the club head. In order to adjust the angle, the hosel must be replaced with another hosel. The hosels are composed of a material softer than the club head.

The prior art also contains the use of inserts for non-adjustment purposes. One example of the prior art is Chappell, U.S. Pat. No. 5,688,188 for a golf club. The Chappell patent discloses an iron with a ferrule composed of a thermoplastic material having a modulus of elasticity of 80–1980 pounds per square inch, a specific gravity of 1.15 to 1.22, shore hardness of 60, and an Izod strength of 3.0 to 10.0 ft/lbs. The ferrule is placed within an external hosel, and the exposed end of the ferrule 21 millimeters. The preferred material is a butyrate.

Another example is Dekura, U.S. Pat. No. 5,766,089, which was originally filed in Japan in 1994 for a metal wood composed of magnesium or aluminum alloy with a hosel attaching section composed of ABS and epoxy. The rigidity of the hosel attaching section is lower than the shaft to absorb vibration and shock to thereby reduce vibrations through the shaft.

Another example is Take et al., U.S. Pat. No. 5,575,723, originally filed in Japan in 1994 for a Golf club With Cushion Material Between Shaft And Head. The Take patent discloses the use of a cushioning member composed of a synthetic resin such as ABS resin, polycarbonate, or epoxy, in order to cushion the shaft within the metal head.

Another example is Allen, U.S. Pat. No. 5,888,149 which was originally filed in 1999 for a shortened hosel and an extended ferrule. The primary object of the Allen patent is to reduce hosel weight without sacrificing shaft support or cosmetic integrity. The Allen patent discloses a hosel with a length of 0.625 inch to 0.750 inch, and an extended ferrule composed of a high strength thermoplastic.

One of the earliest example is Offutt, U.S. Pat. No. 1,167,922, originally filed in 1914 for a golf club head with an enlargement on a tubular metal shaft to provide a fluted surface.

However, golfers want a high performance golf club that can be easily customized to them while golf equipment manufacturers need to provide as much standardization as possible in order to prevent escalation of manufacturing costs. Thus, although the prior art has presented many inventions for providing customization, the prior art has failed to provide a cost effective method of customization.

BRIEF SUMMARY OF THE INVENTION

The present invention provides a solution to the cost-effective customization of golf clubs while provide golfers with golf clubs that they currently play and trust to give them optimal performance. The present invention is able to accomplish this by providing a wood-type golf club head with an insert for orientation of the golf club face angle subsequent to the manufacturing of the golf club head.

A golf club head is typically manufactured using a casting procedure or a forging procedure. Typically, the face angle of the golf club is fixed at the time of manufacture since the location and orientation of the hosel is integrally manufactured with the entirety of the golf club head. Depending on manufacturing tolerances, the intended face angle, or effective loft angle, could be off several degrees or more. The present invention overcomes this problems by fixing the face angle of the golf club post-manufacturing through use of an insert.

One aspect of the present invention is a golf club including a golf club head, an insert and a shaft. The golf club head has a crown, a sole, a striking plate and an internal hosel. The internal hosel has a hosel wall defining a bore that extends from a crown opening below a top of the crown to a sole opening at the sole. The insert is disposed within the internal hosel. The insert has a cylindrical body that extends from the crown opening to the sole opening. The cylindrical body defines a bore that extends from the crown opening to the sole opening. The bore is disposed at a predetermined angle within the cylindrical body to define a face angle of the golf club. The shaft has a tip end and a butt end. The tip end of the shaft is positioned through the bore of the insert to the sole opening.

Another aspect of the present invention is a method for manufacturing a golf club. The method begins with providing a golf club head having a crown, a sole, a striking plate and an internal hosel extending from the crown to the sole. The internal hosel has a hosel wall defining a bore that extends from a crown opening below a top of the crown to a sole opening in the sole. The next step is attaching a removable insert to a tip end of a shaft. The insert has a cylindrical body that defines a bore extending therethrough. The shaft is positioned within the bore. The next step is orienting the insert to define the face angle of the golf club. The next step is placing the shaft, while attached to the insert, within the internal hosel of the golf club head. An excess portion of the tip end of the shaft and an excess portion of the insert extends further than the sole opening. The next step is cutting the excess portions of the tip end of the shaft and the insert at the sole opening to define a relatively smooth sole surface.

Yet another aspect of the present invention is a golf club including a golf club head, an insert, a hosel liner and a shaft. The golf club head has a crown, a sole, a striking plate and an internal hosel extending from the crown to the sole. The internal hosel has a hosel wall defining a bore that extends from a crown opening below a top of the crown to a sole opening in the sole. The insert is disposed within the bore of the internal hosel. The insert has a cylindrical body that extends from the crown opening to the sole opening. The cylindrical body defines a bore that has an upper chamber in communication with the crown opening and a lower chamber in communication with the upper chamber and the sole opening. The bore defines a face angle of the golf club. The hosel liner has an upper portion, a lower portion and a bore therethrough. The upper portion has a greater diameter than the lower portion, and the lower portion positioned within the upper chamber of the bore of the insert. The hosel liner has a shoulder below the upper portion that engages the crown, and the hosel liner is composed of a polymer material. The shaft has a tip end and a butt end. The tip end of the shaft is positioned through the bore of the hosel liner and through the bore of the insert to the sole opening.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
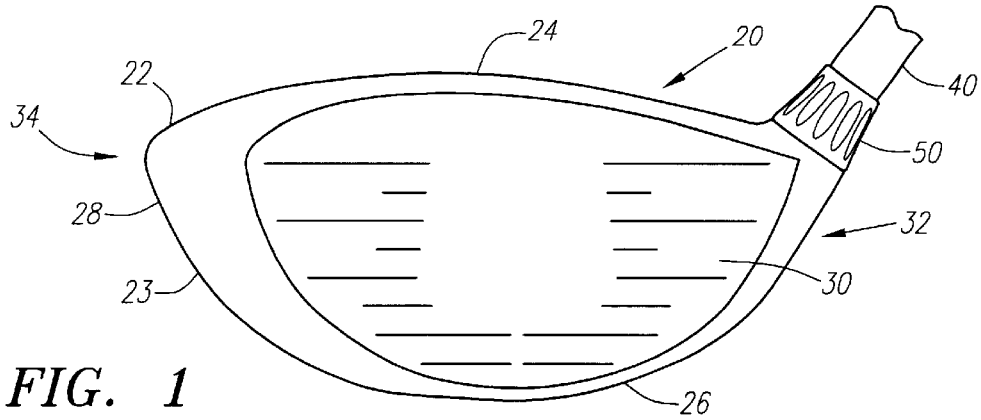
FIG. 1 is a front plan view of the golf club of the present invention.
Figure 2:
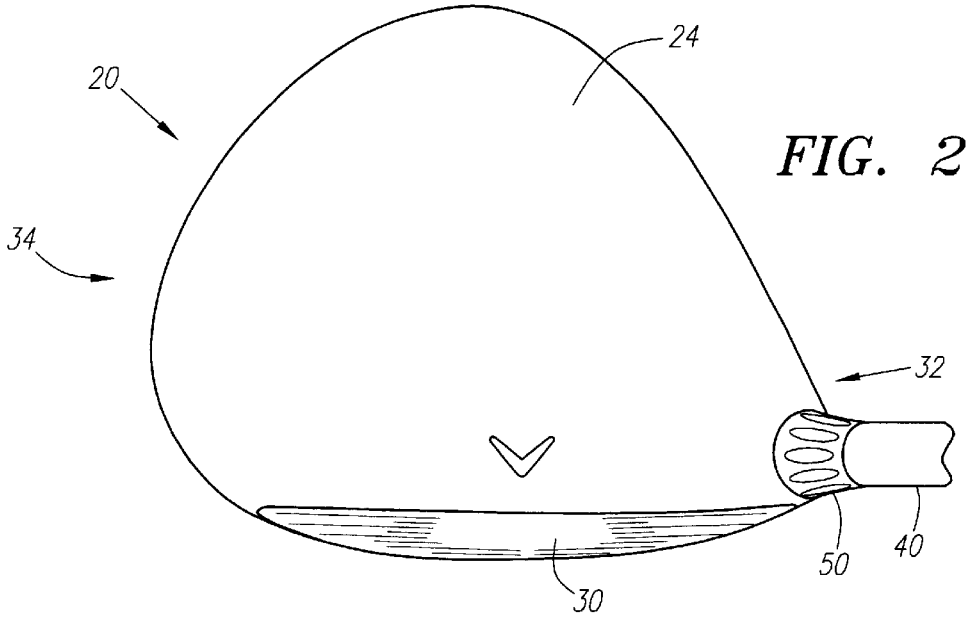
FIG. 2 is a top plan view of the golf club of FIG. 1.
Figure 3:
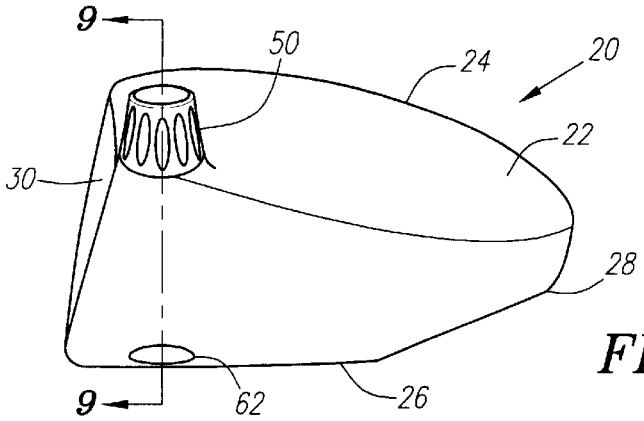
FIG. 3 is a heel end side view of the golf club of FIG. 1.
Figure 4:
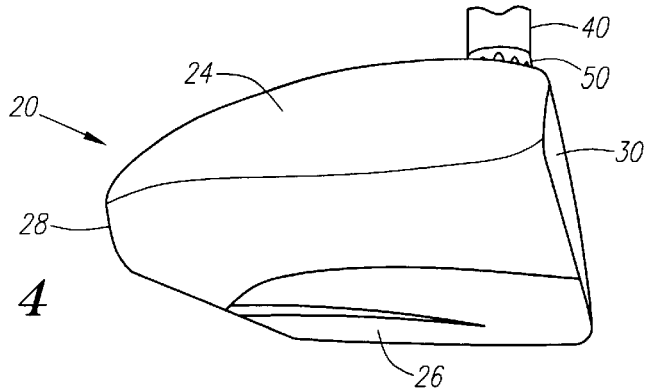
FIG. 4 is a toe end side view of the golf club of FIG. 1.
Figure 5:
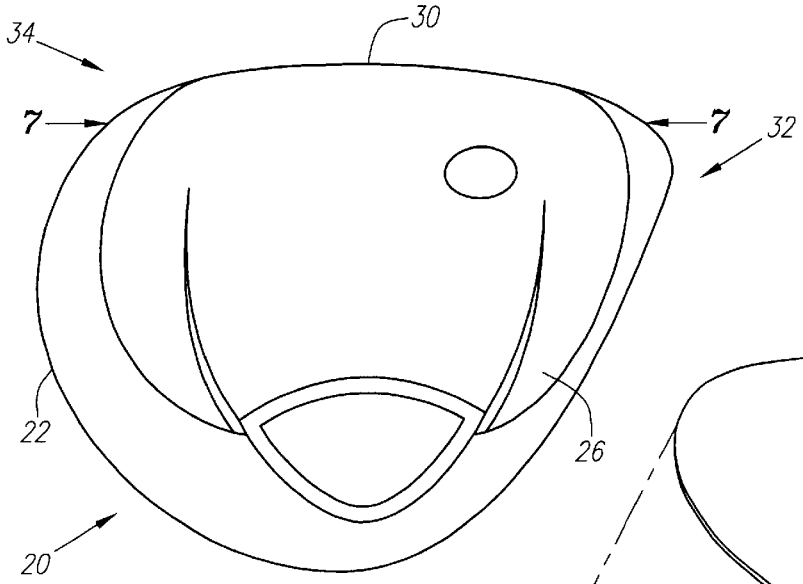
FIG. 5 is a bottom plan view of the golf club of FIG. 1.
Figure 6:
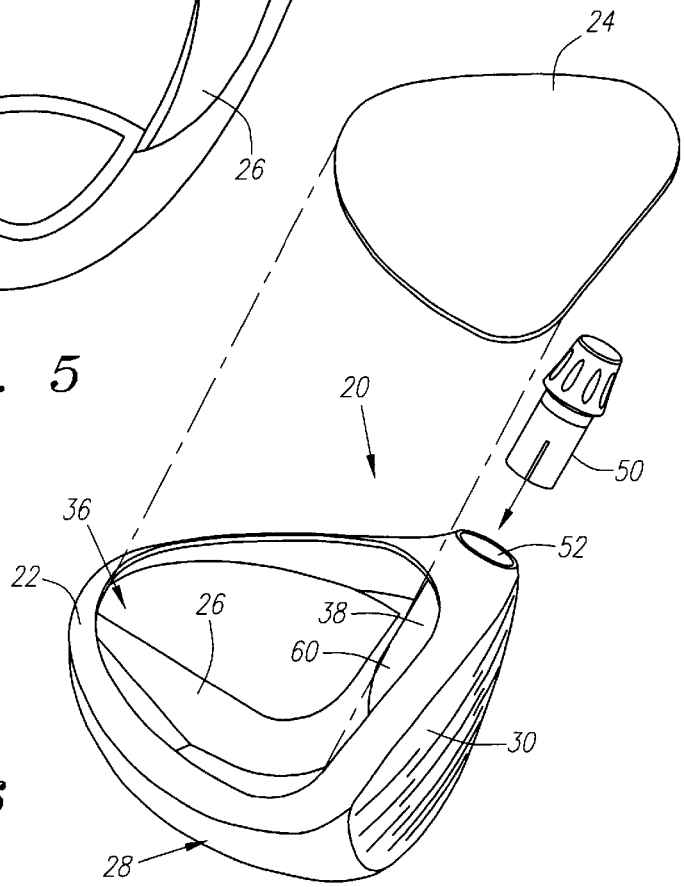
FIG. 6 is an exploded perspective view of the golf club of FIG. 1.

As shown in FIGS. 1–4, a golf club is generally designated 20. The golf club 20 has a golf club head 22, a shaft 40 and a hosel liner 50. The golf club head 22 has a body 23 with a crown 24, a sole 26, a ribbon 28 and a striking plate 30. The striking plate 30 generally extends from a heel end 32 to a toe end 34 of the front of the golf club head 20. The body 23 preferably has a hollow interior 36 with an internal hosel 38 for receiving the tip end of a shaft 40 through the hosel liner 50 which is disposed within an insert 51. As will be explained in greater detail below, the insert 51 allows for post-manufacturing adjustment of the face angle of the golf club 20.

The golf club head 22 has a body 23 that is preferably composed of a metal material such as titanium, titanium alloy, stainless steel, or the like, and is most preferably composed of a forged titanium material. However, those skilled in the pertinent art will recognize that the body 23 may be composed of alternative materials such as composites such as a pre-peg resin with carbon strands.

The body 23, when designed as a driver, preferably has a large volume, typically greater than 300 cubic centimeters, and is most preferably 350 cubic centimeters for a body 23 composed of titanium. However, when designed as a driver, a body 23 composed of stainless steel may have a volume range of 200 cubic centimeters to 275 cubic centimeters, and a body 23 composed of a composite material may have a volume of 325 cubic centimeters to 400 cubic centimeters. The body 23, when designed as a driver, preferably weighs no more than 215 grams, and most preferably weighs between 180 and 205 grams. When the body 23 is designed as a fairway wood, the body 23 weighs from 135 grams to 180 grams, and preferably from 140 grams to 165 grams.

The shaft 40 is preferably composed of a graphite material, however, it may be composed of a lightweight metal material such as titanium. Alternatively, the shaft 40 may be composed of a hybrid of graphite and metal. Yet further, the shaft 40 may be composed of a thin stainless steel material. The weight of the shaft 40 preferably ranges from 40 grams to 80 grams, more preferably from 50 grams to 75 grams, and is most preferably 65 grams.

The shaft 40 is attached to the golf club head 22 through the hosel liner 50 and the insert 51. The insert 51 is positioned within the internal hosel 38 of the golf club head 22. The hosel liner 50 is positioned within insert 51.

Figure 7:
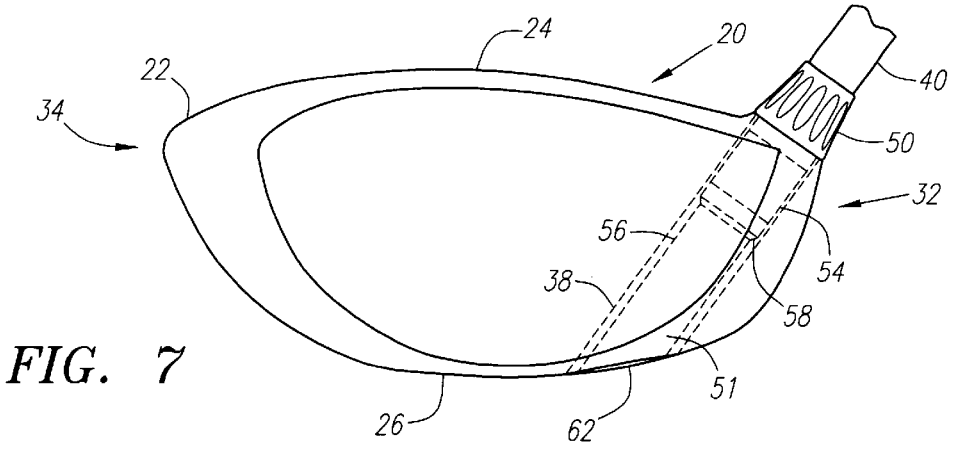
FIG. 7 is a front plan view of the golf club of FIG. 1 with the internal hosel, removable insert and hosel liner in phantom.
Figure 8:
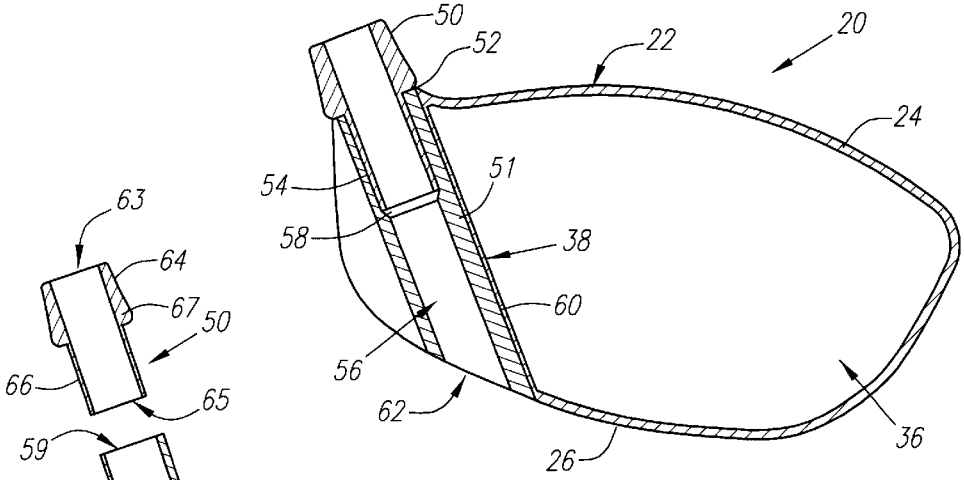
FIG. 8 is a cross-sectional view of line 8—8 of FIG. 3.
Figure 9:
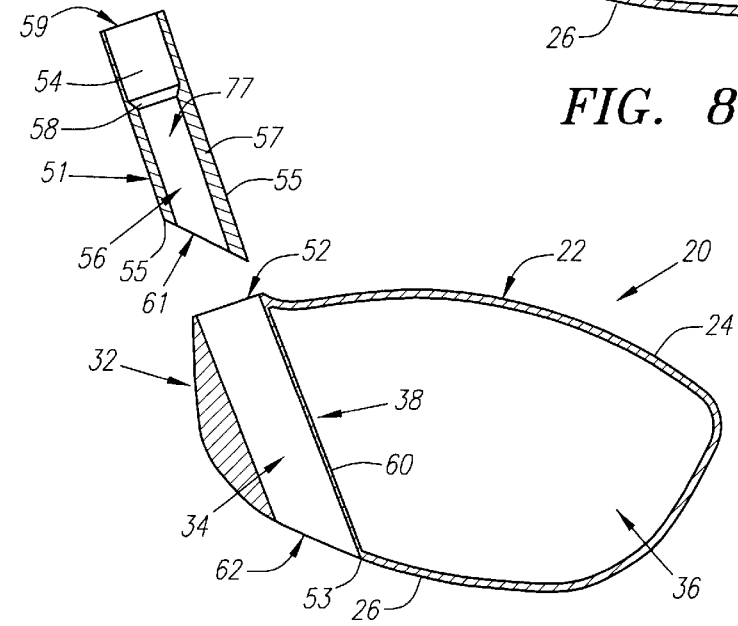
FIG. 9 is an exploded view of FIG. 8.
Figure 10:
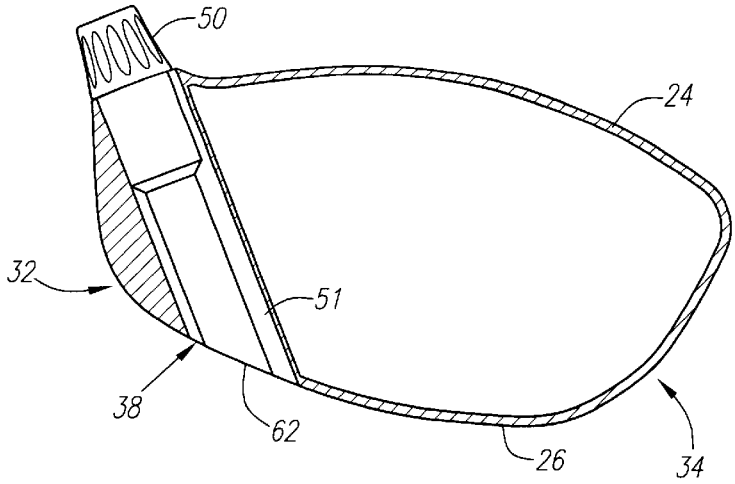
FIG. 10 is a cross-sectional view of the front of the golf club head.
Figure 11:
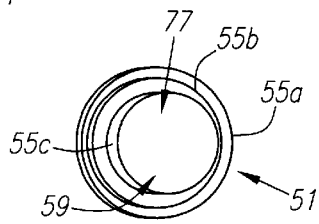
FIG. 11 is an isolated top view of the removable insert.
Figure 12:
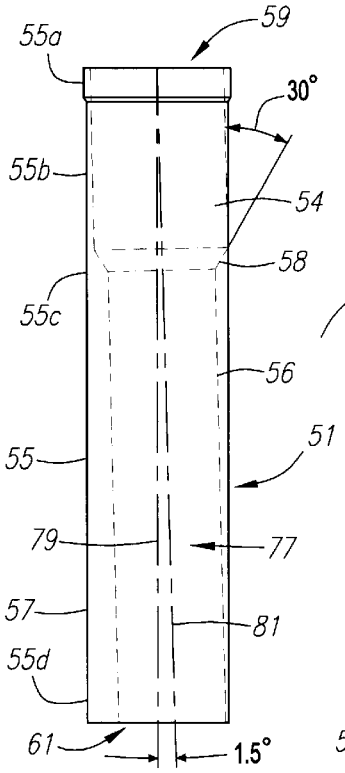
FIG. 12 is an isolated side view of the removable insert.
Figure 14:
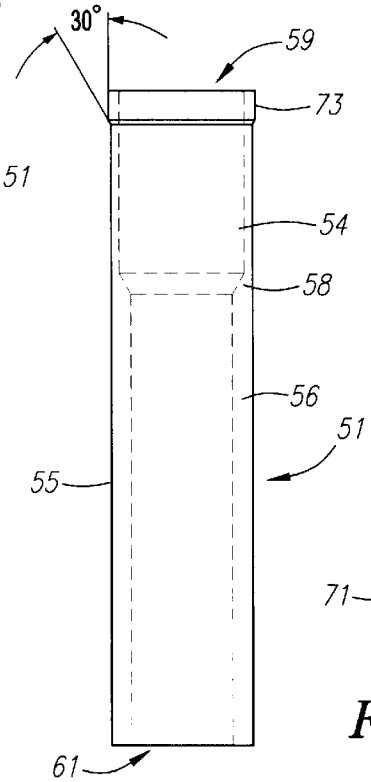
FIG. 14 is an isolated side view of an alternative removable insert with a different bore angle.
Figure 13:
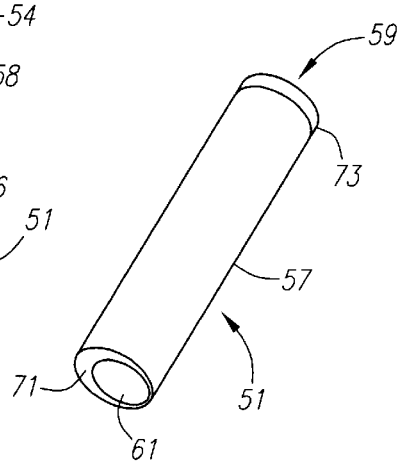
FIG. 13 is an isolated perspective view of the removable insert.

The internal hosel 38 does not substantially extend beyond the surface of the crown 24 of the golf club head 22. More precisely, the internal hosel 38 is lower than the top of the crown 24 when the golf club 20 is in the address position to strike a golf ball. The internal hosel 38 is positioned within the hollow interior 36 of the golf club head 22, nearest the heel end 32. As best shown in FIGS. 7–9, the internal hosel 38 includes a wall 60 that defines a bore 39 that opens at a crown opening 52 and a sole opening 62 of the body 23. The bore 39 is sized to accommodate the insert 51. The insert 51 is secured within the bore 39 of the internal hosel 38 through application of an adhesive, such as an epoxy, to the external surface of the insert 51. The internal hosel 38 is preferably cast with the body 23 of the golf club head 22. Alternatively, the internal hosel 38 may be welded within the hollow interior 36 in alignment with the crown opening 52 and the sole opening 62 of the body 23. The diameter of the bore 39 is not much greater than the outer diameter of the removable insert 51 thereby allowing for a tight and secure fit of the insert 51 within the bore 39.

The insert 51 has a cylindrical body 57 with a wall 55 that defines a bore 77 that includes an upper chamber 54, a lower chamber 56 and a transition region 58. The upper chamber 54 is in flow communication with a top opening 59 of the insert 51 into which the hosel liner 50 is secured with the insert 51. The lower chamber 56 is in open communication with a bottom opening 61 of the insert 51. The upper chamber 54 is in open communication with the transition region 58 that is in open communication with the lower chamber 56. The upper chamber 54 has a diameter A and the lower chamber 56 has a diameter B. Diameter A is greater than diameter B in order to provide a mechanical locking mechanism for securing of the hosel liner 50. The shaft 40 will extend through the hosel liner 50, into the transition region 58 and then into the lower chamber 56 of the insert 51. The insert is preferably composed of a metal material, however, it may be composed of a polymer material. A preferred metal material is aluminum. Other metal materials are stainless steel, titanium, titanium alloys and the like. Polymer materials include thermoplastic polyurethanes, phenoxies, polyamides and the like.

As shown in FIGS. 11–14, the insert 51 has a length that extends from the crown opening 52 to the sole opening 62. The bore 77 is angled relative to a central axis 79 of the cylindrical body 57 such that a central axis 81 of the bore 77 is at an angle of between 0 to 3.5 degrees relative to the central axis 79 of the insert 51. The wall 55 varies in thickness from upper chamber 54 having a thickness of 55*b* to transition having a thickness of 55*c* to the lower chamber 56 having a thickness of 55*d*. Further, due to the angling of the bore 77, the thickness on one side is different than the thickness on the other side. Additionally, a flange 73 at the top opening 59 has a thickness 55*a*. The flange 73 allows for facilitated retention and accuracy of location of the insert 51 within the internal hosel 38 during manufacturing of the golf club 20.

The internal angling of the bore 77 relative to the cylindrical body 57 allows for the adjustment of the face angle of the golf club 20. Further, a quarter rotation of the insert 51 within the internal hosel 38 will change the face angle of the golf club 20 by a predetermined amount. A half rotation will further adjust the face angle, and a three-quarters adjustment will modify the face angle even further. Additional adjustments to the face angle of the golf club 20 are accomplished by exchanging a first insert 51 having a first bore angle relative to a central axis 79 of the cylindrical body 57 with a second insert 51 having a second bore angle relative to a central axis 79 of the cylindrical body 57. Thus, the golf club head 22 may be manufactured within predetermined specifications for a genus of golfers (an example would be golfers requiring a particular driver) while each insert 51 allows for a specific species of golfers (example would be golfers requiring a specific face angle).

The hosel liner 50 generally includes an upper portion 64 and a lower portion 66. The hosel liner has an external opening 63 and an internal opening 65. The lower portion 66 is positioned within the upper chamber 54 of the insert 51. The diameter A of the upper chamber 54 should securely accommodate the diameter of the lower portion 66. The upper portion 64 rests above the crown 24.

Figure 15:
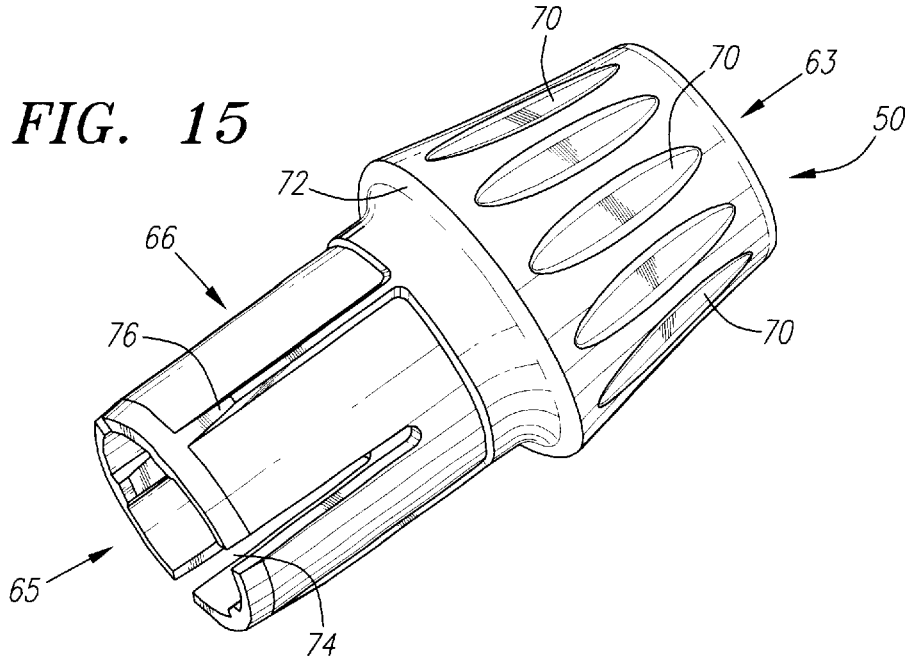
FIG. 15 is an isolated perspective view of the hosel liner.
Figure 16:
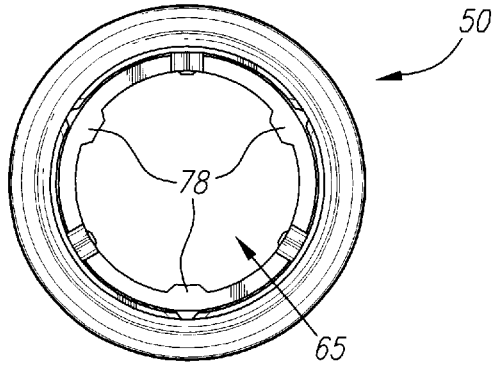
FIG. 16 is an isolated bottom view of the hosel liner.
Figure 17:
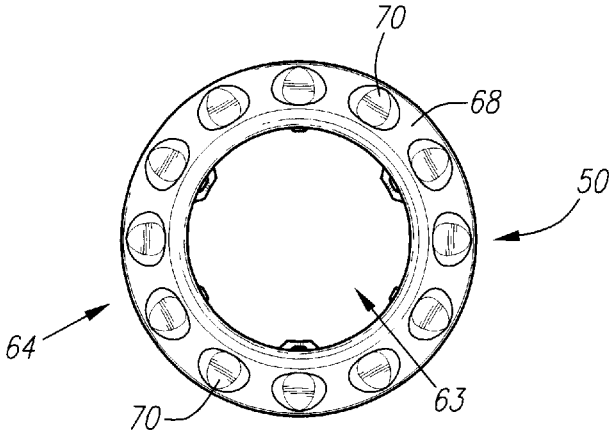
FIG. 17 is an isolated top view of the hosel liner.

As shown in FIGS. 15–17, the upper portion 64 has an exterior surface 68 with a plurality of recesses 70 therein. The surface 68 of the upper portion is curved, and the outer diameter increases in size toward the lower portion 66. The upper portion 64 ends at a shoulder 72 that rests on the crown 24 of the golf club head 22 when the lower portion of the hosel liner 50 is placed within the insert 51. The curved surface 68 of the upper portion 64 of the hosel liner 50 is discontinuous with the surface of the crown 24.

The lower portion 66 has a cylindrical surface 73 with major slots 74 and minor slots 76.

The major slots extend along a substantial portion of the surface 73 and are open at the internal opening 65. The interior surface of the lower portion 66 has projections 78 that engage the shaft 40. The hosel liner 50 is preferably composed of a polymer material such as a polycarbonate material. The hosel liner 50 is designed to relieve stress that is placed on the shaft 40 during the impact between a golf club head 22 impact and a golf ball. The hosel liner 50 prevents substantial contact between the shaft 40, typically graphite, and the metal golf club head 22.

In manufacturing the golf club 20, the tip end of a shaft 40 is inserted through the external opening of the hosel liner 50. Then, the hosel liner 50 and the shaft 40 are inserted through the top opening 59 of the insert 51. Then, the shaft 40, hosel liner 50 and insert 51 are inserted through the crown opening 52. An excess portion 95 of the tip end of the shaft 40 and an excess portion 97 of the insert 51 extend beyond the surface of the sole 26. These excess portions 95 and 97 are cut to create a smooth surface at the sole opening 62.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention:

1. A golf club comprising:

a wood-type golf club head having a crown, a sole and a striking plate, the crown, the sole and the striking plate defining a hollow interior, the golf club head having an internal hosel disposed within the hollow interior, the internal hosel having a hosel wall defining a bore that extends from a crown opening at the crown to a sole opening at the sole;

an insert disposed within the bore of the internal hosel, the insert having a cylindrical body extending from the crown opening to the sole opening, the cylindrical body defining a bore that extends from the crown opening to the sole opening, the bore of the insert disposed at an angle of between 0 to 3.5 relative to a central axis of the insert within the cylindrical body, a hosel liner having an upper portion, a lower portion and a bore therethrough for positioning of the shaft therein, the upper portion having a greater diameter than the lower portion, the upper portion having a curved surface with a plurality of recesses therein, the lower portion positioned within the internal hosel, the hosel liner having a shoulder below the upper portion, the shoulder engaging the crown, and the hose liner composed of a polymer material; and a shaft having a tip end and a butt end, the tip end of the shaft positioned through the bore of the insert to the sole opening;

wherein the angle of the bore of the insert relative to the central axis of the insert defines a face angle of the golf club.

2. The golf club according to claim 1 wherein the golf club head is composed of a material selected from the group consisting of titanium, titanium alloys, stainless steel, amorphous metals, a composite material, magnesium, and a polymer material.

3. The golf club according to claim 1 wherein the insert has an upper chamber and a lower chamber, the upper chamber having a diameter greater than the lower chamber, the lower portion of the hosel liner positioned within the upper chamber.

4. The golf club according to claim 1 wherein the bore of the insert is at angle such that a quarter rotation of the removable insert within the bore of the internal hosel will result in a modification of the face angle of the golf club.

5. The golf club according to claim 1 wherein the golf club head has a volume greater than 250 cubic centimeters.

6. The golf club according to claim 1 wherein the golf club head weighs between 180 grams and 205 grams.

7. A golf club comprising:

a wood-type golf club head having a crown, a sole and a striking plate, the crown, the sole and the striking plate defining a hollow interior, the golf club head having an internal hosel disposed within the hollow interior, the internal hosel having a hosel wall defining a bore that extends from a crown opening at the crow to a sole opening at the sole;

an insert disposed within the bore of the internal hosel, the insert having a cylindrical body extending from the crown opening to the sole opening, the cylindrical body defining a bore that extends from the crown opening to the sole opening, the bore of the insert disposed at an angle of between 0 to 3.5 relative to a central axis of the insert within the cylindrical body, a hosel liner having an upper portion, a lower portion and a bore therethrough for positioning of the shaft therein, the upper portion having a greater diameter than the lower portion, the lower portion having a plurality of slots and a plurality of interior projections, the lower portion positioned within the internal hosel, the hosel liner having a shoulder below the upper portion, the shoulder engaging the crown, and the hosel liner composed of a polymer material; and a shaft having a tip end and a butt end, the tip end of the shaft positioned through the bore of the insert to the sole opening;

wherein the angle of the bore of the insert relative to the central axis of the insert defines a face angle of the golf club.

* * * * *